United States Patent [19]

Klett et al.

[11] 4,180,926

[45] Jan. 1, 1980

[54] LOAD ABSORBING MEANS FOR CUTTING EDGE ASSEMBLY

[75] Inventors: Gene R. Klett; William E. Lanz, both of Joliet, Ill.

[73] Assignee: Caterpillar Tractor Co., Peoria, Ill.

[21] Appl. No.: 874,725

[22] Filed: Feb. 3, 1978

[51] Int. Cl.[2] ..... E02F 9/28

[52] U.S. Cl. ..... 37/142 R

[58] Field of Search ..... 37/141 R, 141 T, 142 R, 37/142 A

[56] References Cited

U.S. PATENT DOCUMENTS

| | | | |
|---|---|---|---|
| 4,052,803 | 10/1977 | Lanz et al. | 37/142 R |
| 4,120,105 | 10/1978 | Stepe | 37/142 R |

FOREIGN PATENT DOCUMENTS

| | | | |
|---|---|---|---|
| 2458361 | 12/1974 | Fed. Rep. of Germany | 37/142 R |
| 1335412 | 7/1963 | France | 37/142 R |

*Primary Examiner*—E. H. Eickholt

*Attorney, Agent, or Firm*—Phillips, Moore, Weissenberger, Lempio & Majestic

[57] ABSTRACT

A specialized load absorbing apparatus is disclosed for fastening tooth adaptors adjacent the cutting edge of an earthworking tool. The adaptor is especially useful with relatively sharp cutting edges wherein the edge itself cannot be used to absorb the load. The apparatus includes conical seats between the adaptor and the cutting edge and/or a specialized wear plate which locates below the cutting edge and absorbs some of the forces exerted on the adaptor.

16 Claims, 9 Drawing Figures

LOAD ABSORBING MEANS FOR CUTTING EDGE ASSEMBLY

BACKGROUND OF THE INVENTION

1. Field of the Invention

The invention relates to load absorbing means for absorbing the load exerted upon earthworking teeth and more particularly upon the adaptors therefor.

2. Prior Art

Cutting edges are used on a number of earthworking machines. For example such edges are provided on bucket bases, scrapers and the like. The cutting edges may be formed directly on to a support plate, for example, a bucket base or a cutting assembly which is itself bolted in place to the bucket base to extend forwardly therefrom. Adaptors are generally provided which extend forwardly of the cutting edge and to which earthworking teeth are removably attached. In the past, the cutting edges have been generally relatively blunt and the adaptors for the earthworking teeth have fit snugly about these blunt cutting edges whereby forces exerted upon the adaptor due to the earthworking teeth being subjected to their normal work conditions have been directly dissipated into the relatively blunt cutting edges. The adaptors themselves have been fastened to the support plate generally either via welding or bolts. Because of the abutting of the adaptor with the cutting edge part of the strain on the adaptors have been dissipated thereat and the bolts have not been subjected to such large strains as would cause them to shear off in short periods of time.

It is desirable to be able to provide sharper cutting edges than have previously been used in order to provide more efficient scraping operation by the cutting edge. However, when the cutting edge is made sharper the adaptor forces cannot be dissipated directly on the now sharper cutting edge because these new sharper cutting edges have simply not been strong enough to withstand these forces. Thus an attempt to make use of the prior art structure with sharper cutting edges would simply lead to bending and/or blunting of the cutting edge and/or the support plate. When bolts are used to hold the adaptor in place and the now sharper cutting edge is not used to absorb some of these forces being exerted upon the adaptor, the bolts simply shear off. Accordingly, prior art structures for removably attaching adaptors to cutting edge support plates have been found to be inadequate when it is desired to make use of a sharper cutting edge than heretofore normally used.

SUMMARY OF THE INVENTION

The present invention is directed to overcoming one or more of the problems as set forth above.

According to the present invention an improvement is provided in a tooth mounting assembly for an earthworking element which comprises a support plate having a cutting edge along a front side thereof and an adaptor for an earthworking tooth attached to the support blade and extending forwardly past the cutting edge. The improvement comprises a first conical seat formed in a top of the support plate; a first conical taper extending downwardly from the adaptor; and means for fastening the seat in mating supportive contact with the taper.

In another sense the improvement comprises a conical seat formed in a top of the support plate; a hole extending through the adaptor from a top thereof to the seat; a shear ring positioned within the hole; a conical taper formed on the shear ring and extending downwardly therefrom; means for fastening the seat in mating supportive contact with the taper; a plurality of radial slots through the shear ring above the second taper; and means for forcing the shear ring to expand outwardly intermediate the slots to cause an outer circumferential region of the shear ring to supportively contact the hole.

In yet another sense the improvement comprises a strap unitarily formed as part of the adaptor, the strap extending rearwardly along the bottom of the support plate from adjacent the cutting edge; a wear plate abutting the bottom of the support plate; a first tap from the top of the support plate to the bottom of the wear plate, the first tap being positioned beyond a rearward end of the strap; a second tap from the top of the support blade to the bottom of the wear plate, the second tap being further removed from the cutting edge than is the first tap; a channel extending forwardly from the rearward end of the strap and upwardly from a bottom thereof, the channel having a cross-section which tapers inwardly; and a tongue unitary with and extending forwardly from the wear plate, the tongue having a cross-section which tapers at an angle to cause the tongue to abuttingly fit within the sides of the channel.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENTS

Figure 1:
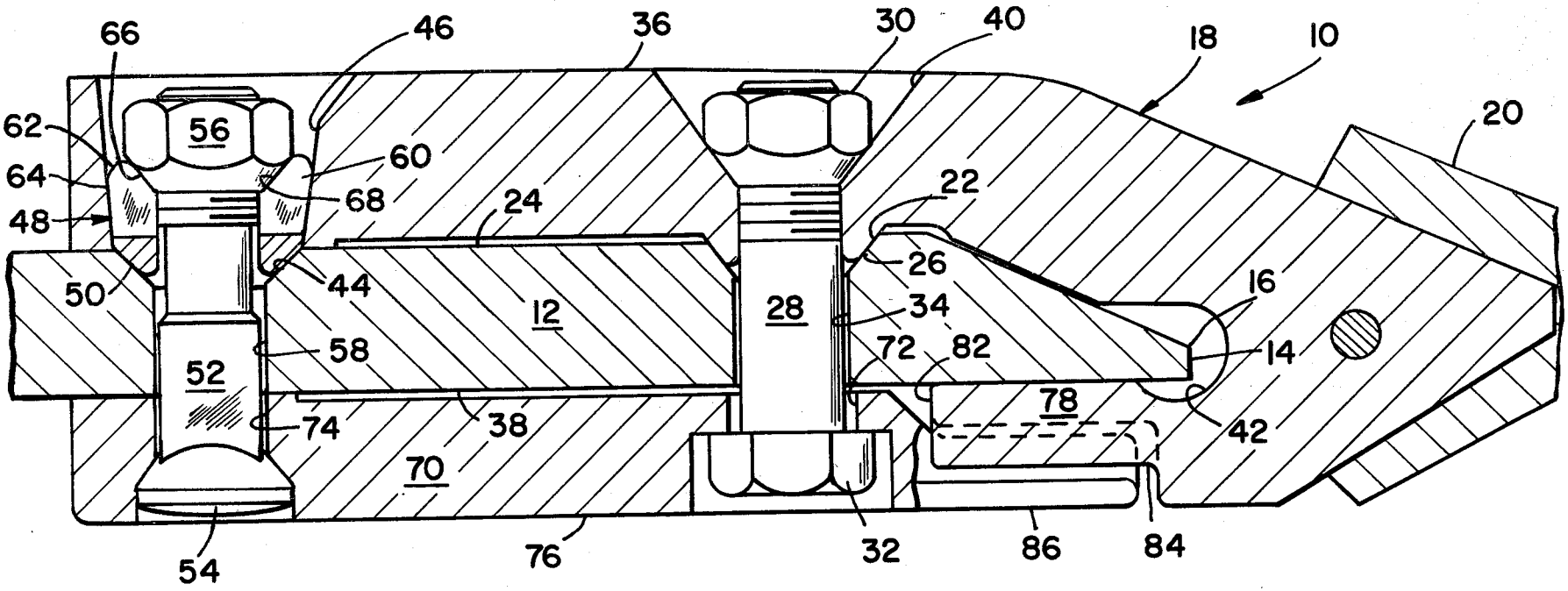
FIG. 1 illustrates in side section one embodiment of the present invention.

Adverting first to FIG. 1 there is illustrated an improved tooth mounting assembly 10 in accordance with the present invention. The assembly includes a support plate 12 which in the particular embodiment illustrated simply comprises the base of a bucket, the support plate 12 having a cutting edge 14 along a front side 16 thereof. The tooth mounting assembly 10 further includes an adaptor 18 for an earthworking tooth 20. The adaptor 18 is attached to the support plate 12 and extends forwardly past the cutting edge 14. The present invention relates particularly to the attachment of the adaptor 18 to the support plate 12.

To attain the necessary attachment a first conical seat 22 is formed in a top 24 of the support plate 12. Also, a first conical taper 26 is provided which extends downward from the adaptor 18. Finally, means are provided for fastening the seat 22 in mating support of contact with the taper 26 whereby forces exerted on the adaptor 18 are dissipated in the contact area of the seat 22 with the taper 26. In the paricular embodiment illustrated the fastening means comprises a first bolt 28 along with a first nut 30, with the bolt 28 having a head 32. The first bolt 28 passes through a first bore 34 which proceeds from a top 36 of the adaptor 18 to a bottom 38 of the support plate 12. The top 36 of the adaptor 18 will generally include a first countersunk bore 40 which serves for substantially completely accepting the first nut 30 or as an alternative the first bolt head 32 (if properly shaped). Since forces on the adaptor 18 are dissipated in the contact area of the seat 22 with the taper 26, heavy shear forces are not applied to the first bolt 28 or the first nut 30 and shearing off of the first bolt 28 or first bolt head 32 does not occur.

The adaptor 12 will generally include a cavity 42 formed therein to provide a clearance about the cutting edge 14. In this manner damage to the cutting edge 14 due to forces exerted upon the adaptor 18 is prevented.

Figure 2:
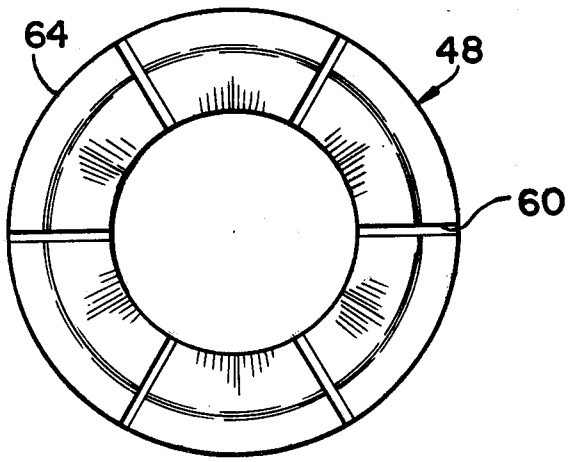
FIG. 2 illustrates in top view a shear ring as is useful in certain embodiments of the present invention.

In the embodiment illustrated in FIG. 1 a second conical seat 44 is formed in the top 24 of the support plate 12. The second seat 44 is arranged to be further removed from the cutting edge 14 than is the first seat 22. A hole 46 is provided through the adaptor 18 from the top 36 thereof to the second conical seat 44. A shear ring 48 shown in FIGS. 1 and 2 is positioned within the hole 46. A second conical taper 50 is formed on the shear ring 48 and extends downwardly therefrom. Means are provided for fastening the second seat 50 in mating supportive contact with the second taper 44. In the particular embodiment illustrated this means comprises a second bolt 52 having a head 54 along with a second nut 56 which fits on the nonheaded end of the bolt 52 along with a second bore 58 which passes from the top 24 to the bottom 38 of the support plate 12. Thus forces exerted on the adaptor 18 are dissipated at the spaced apart contact areas defined by seat 22 and taper 26 and seat 44 and taper 50.

A plurality of radial slots 60 are provided through the shear ring 48 above the second taper 50. The slots 60 each proceed to a top 62 of the shear ring 48. Means are provided for forcing the shear ring 48 to expand outwardly intermediate the slots 60 to cause an outer circumferential region 64 of the shear ring 48 to supportably contact the hole 46. This alleviates any requirement for very exact aligning of the hole 46 and bore 40 relative to each other and to the bores 34 and 58. The forcing means in the embodiment illustrated comprises a third conical taper 66 on the second nut 56 or alternatively on the second bolt head 54 which bears against a third conical seat 68 of the shear ring 48 as the bolt 52 and nut 56 are screwed together. As will be noted by reference to FIG. 1 the hole 46 preferably tapers inwardly radially from the top 36 of the adaptor 18 at a lesser angle than the angle of the second taper 50 and the outer circumferential region 64 of the shear ring 48 tapers at substantially the same angle as does the hole 46 to allow proper alignment and positioning of parts.

As may be seen by reference to FIGS. 1–5, 8 and 9, in accordance with several embodiment of the invention a wear plate 70 can abut the bottom 38 of the support plate 12 and has an extension 72 of the first bore 34 therethrough. The second bore 58 likewise extends via an extension 74 which extends to a bottom 76 of the wear plate 70.

In the embodiments of all the Figures, a strap 78 is generally unitarily formed as part of the adaptor 18. The strap 78 extends rearwardly along the bottom 38 of the support plate 12 from adjacent the cutting edge 14 and terminates short of the first bore 34. In the embodiments of FIGS. 1–5 a channel 80 is formed in the strap 78 and extends forwardly from a rearward end 82 of the strap 78 and upwardly from a bottom end 84 of the strap 78. The channel 80 has a cross-section which tapers inwardly as it progresses upwardly from the bottom 84 of the strap 78. A tongue 86 is formed unitarily with and extends forwardly from the wear plate 70. The tongue 86 has a cross-section which causes said tongue to abuttingly fit against the sides 88 of the channel 80. This ensures dissipation of forces from the adaptor 18 to the wear plate 70 thus reducing forces to be exerted upon the first bolt 28, the first nut 30, the second bolt 52 and second nut 56.

ALTERNATE EMBODIMENT OF FIGS. 3–5

Figure 3:
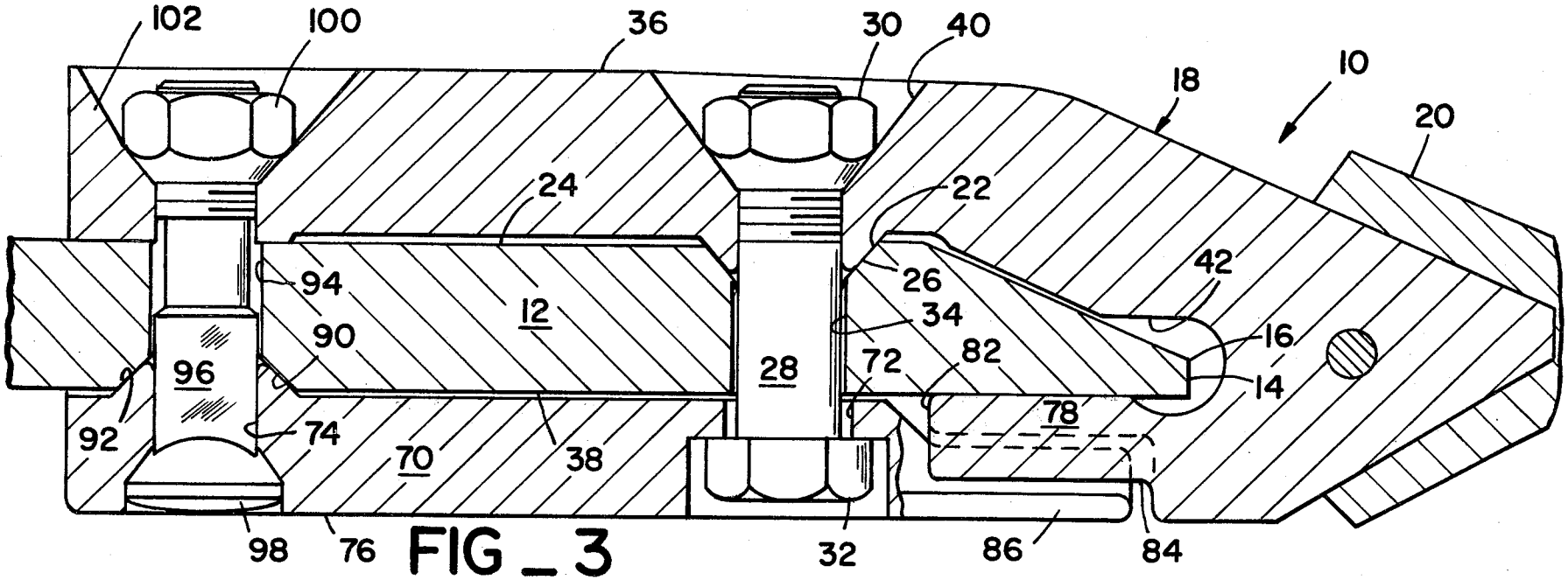
FIG. 3 illustrates in side section an alternate embodiment of the present invention.
Figure 4:
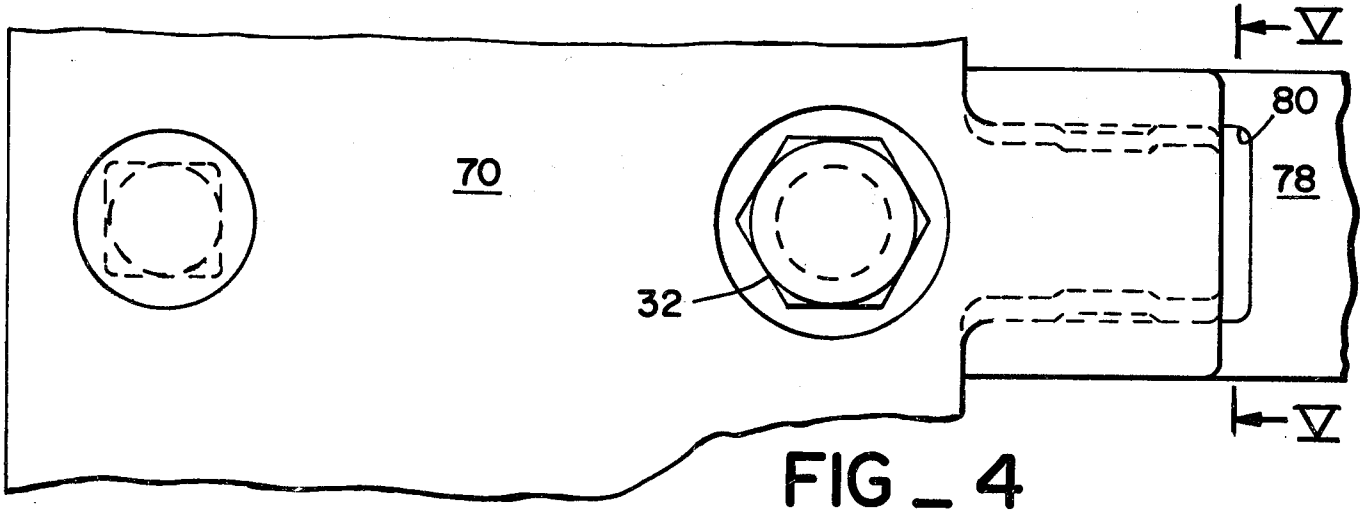
FIG. 4 illustrates a bottom view of the embodiment of FIG. 3.

With particular reference to the embodiment shown most clearly in FIGS. 3 and 4, there is included in place of the previously mentioned arrangement of the shear ring 48, a second conical seat 90 formed in the bottom 38 of the support plate 12. The second conical seat 90 is further removed from the cutting edge 14 than is the first conical seat 22. The wear plate 70 serves as an additional support member beneath the support plate 12. A second conical taper 92 extends upwardly from the wear plate 70 and in this embodiment there is included means for fastening the second seat 92 in mating supportive contact with the second taper 92. Since the second seat 92 is carried by the wear plate 70 and said wear plate 70 can be positioned as desired longitudinally relative to the support plate 12, it is clear that no requirement is introduced of very exact alignment between the adaptor 18 and the wear plate 70. In the particular embodiment illustrated the second seat-taper fastening means comprises a second bore 94 from the top 36 of the adaptor 18 to the bottom 76 of the wear plate 70. The fastening means further comprises a second bolt 96 having a head 98 along with a second nut 100. The adaptor 18 then includes a second countersunk bore 102 for substantially completely accepting the second bolt head 98 or the second nut 100. The countersinking of the various bolt heads and nuts of the embodiments of the invention assures that they are not worn off during use.

It should be noted that the use of the shear ring 48 in conjunction with a conical seat such as the conical seat 44 and with a hole such as the hole 46 through an adaptor 18 is itself advantageous in providing load or force distribution in assemblies wherein an adaptor 18 is fastened to a support plate 12. Further it should be noted that use of the wear plate 70 is likewise particularly useful in combination with the shear ring 48 in the aforementioned environment.

ALTERNATE EMBODIMENT OF FIG. 6

Figure 5:
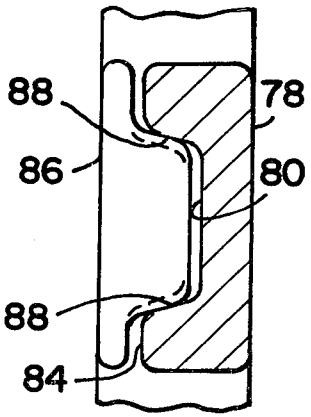
FIG. 5 illustrates a view taken along the line V—V of FIG. 4.
Figure 6:
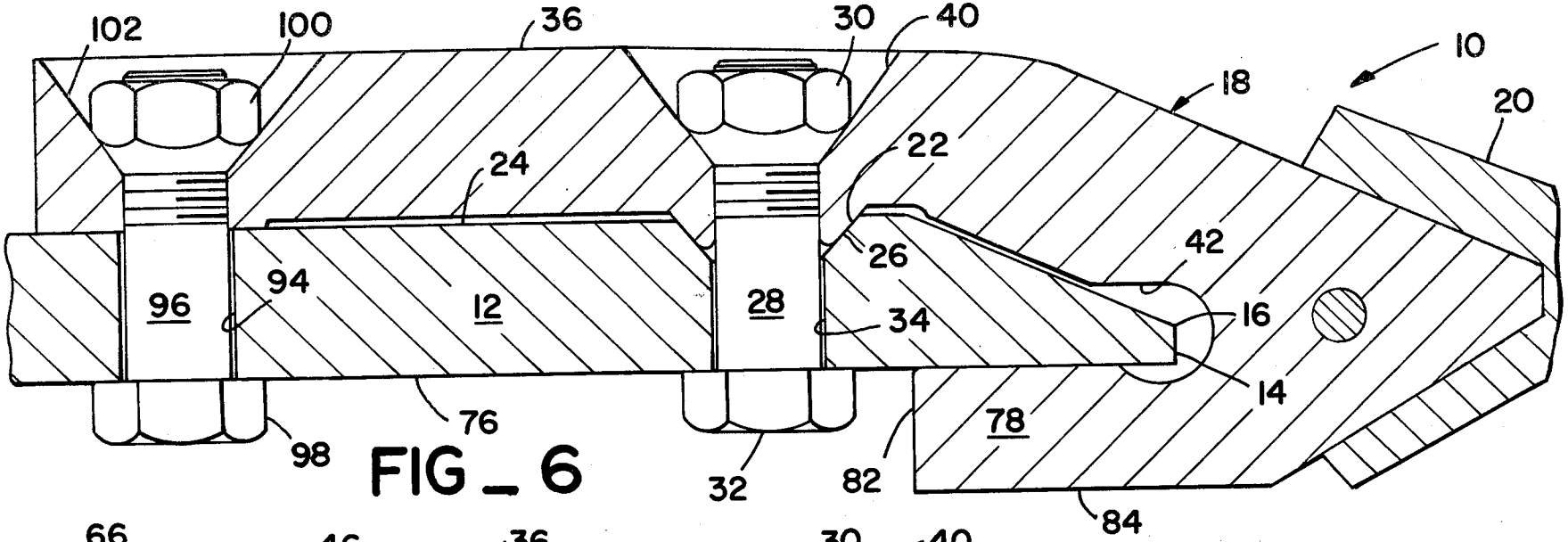
FIG. 6 illustrates yet another alternate embodiment of the present invention.

Adverting now to FIG. 6, there is shown an embodiment in accordance with the present invention which is substantially the same as the embodiment of FIGS. 3–5, but wherein the wear plate 70 is deleted along with the tongue 86 and the channel 80 into which it fits. In the embodiment of FIG. 6 the first bolt 28 fits within the first bore 34 with the first nut 30 held within the first countersunk bore 40. The head 32 of the first bolt 28 fits flatly against the bottom 76 of the support plate 12, is held slightly above ground level and is at least partially protected by the strap 78. Similarly, the second bolt 96 fits within the second bore 94 with the second bolt head 98 fitting flat against the bottom 76 of the support plate 12. A second nut 100 fits within a second countersunk bore 102 to fasten the second bolt 26 in place. Forces are dissipated as in other embodiments of the invention via the bearing of the first conical taper 26 against the first conical seat 22.

ALTERNATE EMBODIMENT OF FIG. 7

Figure 7:
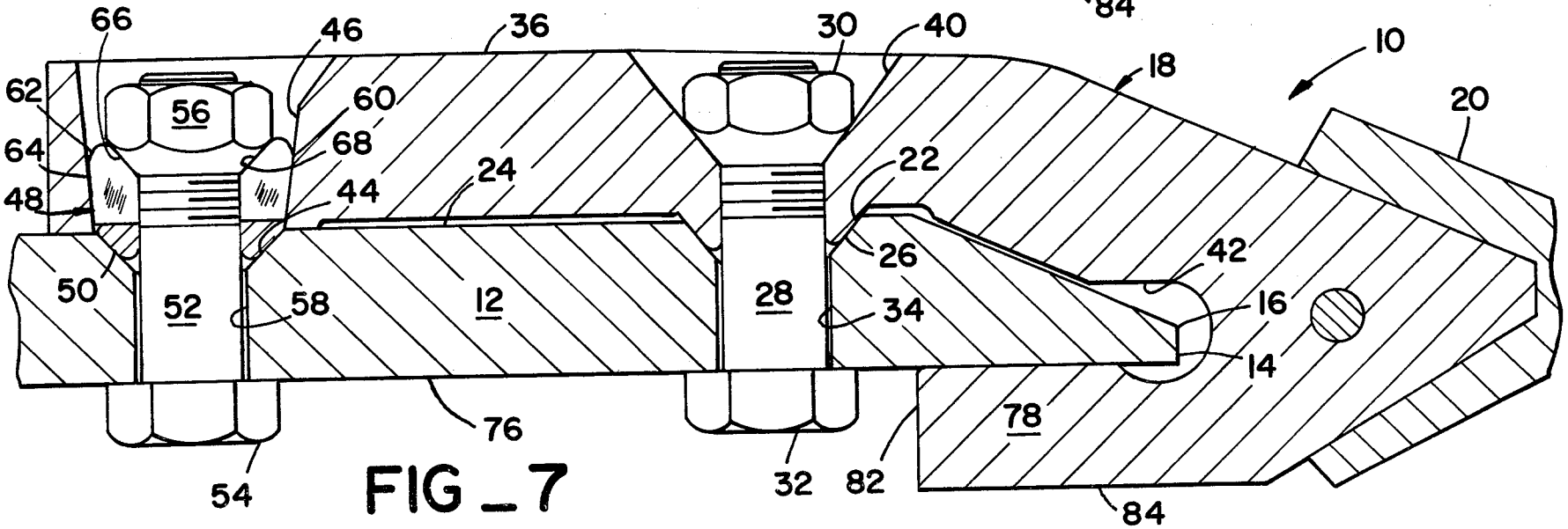
FIG. 7 illustrates still another alternate embodiment of the present invention.

Adverting now to FIG. 7, and for reference also to FIG. 1, it will be noted that FIG. 7 illustrates an embodiment of the invention which is very similar to the embodiment of FIG. 1 with the exception that the wear plate 70 is not present in the embodiment of FIG. 7. Accordingly, the head 32 of the first bolt 28 and the head 54 of the second bolt 52 each fit against the bottom 76 of the support plate 12. As in the embodiment of FIG. 6 the bolt heads are somewhat protected by the strap 78 which serves to effectively at least partially countersink said bolt heads.

ALTERNATE EMBODIMENT OF FIG. 8

Figure 8:
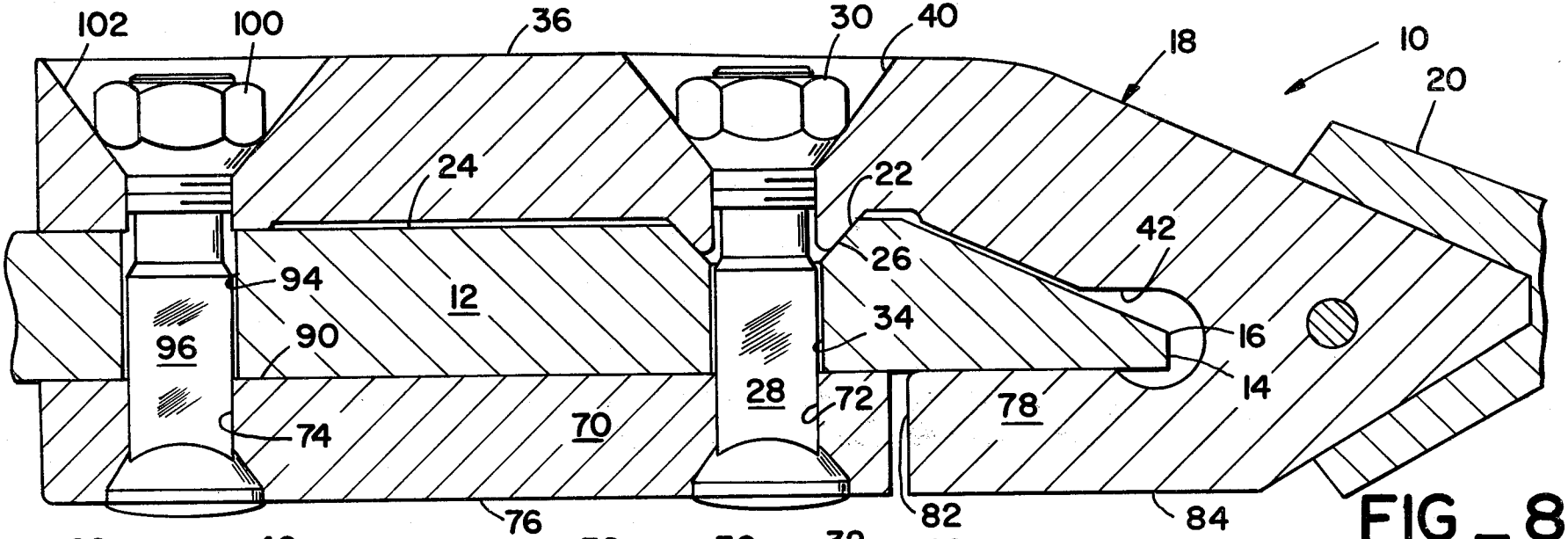
FIG. 8 illustrates an additional alternate embodiment of the present invention.

The alternate embodiment as illustrated in FIG. 8 is identical to the embodiment of FIGS. 3–5 with the exception that the wear plate 70 does not have a tongue 86 extending forwardly therefrom and the strap 78 does not have the channel 80 therein.

ALTERNATE EMBODIMENT OF FIG. 9

Figure 9:
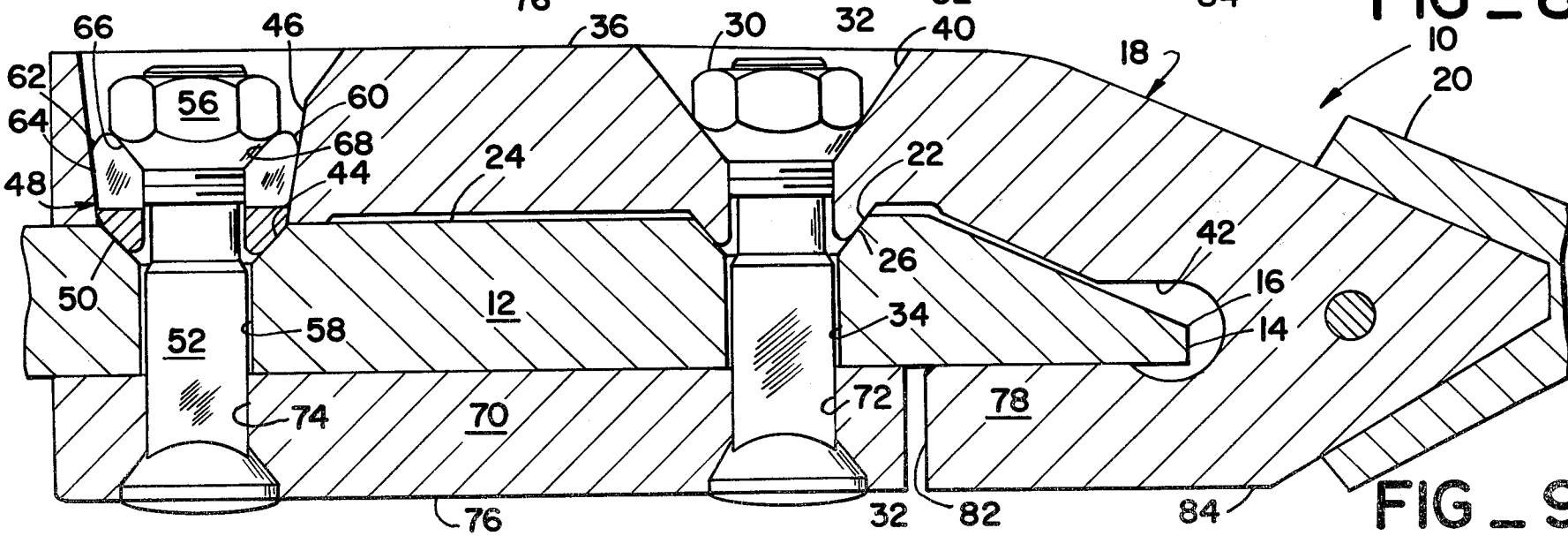
FIG. 9 illustrates yet one more alternate embodiment of the present invention.

The alternate embodiment of FIG. 9 is identical with the embodiment of FIG. 1 with the exception that the wear plate 70 does not have the tongue 86 extending therefrom and the strap 78 does not have the channel 80 therein into which said tongue 86 would fit.

It should be noted that while the various embodiments of the invention vary somewhat structurally, each of these embodiments makes use of a conical seat and mating conical taper for dissipation of forces exerted upon an earthworking tooth 20 so that these forces do not in any way lead to damage of the cutting edge 14. When the aforementioned taper-conical seat force dissipation method is used in conjunction with the use of a cavity 42 about the cutting edge 14, one can use relatively sharp cutting edges without introducing the possibility of damage thereto.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a tooth mounting assembly for an earthworking implement which comprises a support plate having a cutting edge along a front side thereof and an adaptor for an earthworking tooth attached to said support plate and extending forwardly past said cutting edge, an improvement comprising:

a first conical seat formed in a top of said support plate;

a first conical taper extending downwardly from said adaptor; and means for fastening said seat in mating supportive contact with said taper.

2. An improvement as in claim 1, wherein said adaptor includes a cavity formed therein providing a clearance about said cutting edge.

3. An improvement as in claim 1, wherein said first seat-taper fastening means comprises a first bore from the top of said adaptor to a bottom of said support plate, a first headed bolt and a first nut; and including:

a first countersunk bore in said top of said adaptor substantially completely accepting a respective one of said first bolt head and said first nut.

4. An improvement as in claim 1, including:

a second conical seat formed in the top of said support plate, said second seat being further removed from said cutting edge than is said first seat;

a hole through said adaptor from a top thereof to said second conical seat;

a shear ring positioned within said hole;

a second conical taper formed on said shear ring and extending downwardly therefrom;

means for fastening said second seat in mating supportive contact with said second taper;

a plurality of radial slots through said shear ring above said second taper; and means for forcing said shear ring to expand outwardly intermediate said slots to cause an outer circumferential region thereof to supportively contact said hole.

5. An improvement as in claim 4, wherein said first seat-taper fastening means comprises a first bore from the top of said adaptor to a bottom of said support plate, a first headed bolt and a first nut; and including:

a first countersunk bore in said top of said adaptor substantially completely accepting a respective one of said first bolt head and said first nut.

6. An improvement as in claim 5, wherein said second seat-taper fastening means comprises a second bore from the top to the bottom of said support plate, a second headed bolt and a second nut, said forcing means comprises a third conical taper on a respective one of said second bolt head and nut and said shear ring includes a third conical seat against which said third conical taper bears.

7. An improvement as in claim 6, wherein said hole tapers inwardly radially from the top of said adaptor at a lesser angle than an angle of said second taper and said outer circumferential region of said shear ring tapers at substantially the same angle as does said hole.

8. An improvement as in claim 3, including:

a wear plate abutting the bottom of said support plate and having an extension of said first bore therethrough;

a second bore from the top of said adaptor to the bottom of said wear plate, said second bore being further removed from said cutting edge than is said first bore;

a strap unitarily formed as part of said adaptor, said strap extending rearwardly along the bottom of said support plate from adjacent said cutting edge and terminating short of said first bore;

a channel extending forwardly from a rearward end of said strap and upwardly from a bottom thereof, said channel having a cross-section which tapers inwardly; and a tongue unitary with and extending forwardly from said wear plate, said tongue having a cross-section which tapers at an angle to cause said tongue to abuttingly fit against the sides of said channel.

9. An improvement as in claim 1, including:

a second conical seat formed in a bottom of said support plate, said second seat being further removed from said cutting edge than is said first seat;

a member below said support plate;

a second conical taper extending upwardly from said member; and means for fastening said second seat in mating supportive contact with said second taper.

10. An improvement as in claim 9, wherein said first seat-taper fastening means comprises a first bore from the top of said adaptor to the bottom of said support plate, a first headed bolt and a first nut; and including:

a first countersunk bore in said top of said adaptor for substantially completely accepting a respective one of said first bolt head and said first nut.

11. An improvement as in claim 10, wherein said member comprises a wear plate abutting the bottom of said support plate and said second seat-taper fastening means comprises a second bore from the top of said adaptor to a bottom of said wear plate, and said adaptor includes a second countersunk bore for substantially completely accepting a respective one of said second bolt head and said second nut.

12. An improvement as in claim 11, including:

a strap unitarily formed as part of said adaptor, said strap extending rearwardly along the bottom of said support plate from adjacent said cutting edge and terminating short of said first bore;

a channel extending forwardly from a rearward end of said strap and upwardly from a bottom thereof, said channel having a cross-section which tapers inwardly; and a tongue unitary with and extending forwardly from said wear plate, said tongue having a cross-section which tapers at an angle to cause said tongue to abuttingly fit against the sides of said channel.

13. In a tooth mounting assembly for an earthworking implement which comprises a support plate having a cutting edge along a front side thereof and an adaptor for an earthworking tooth attached to said support plate and extending forwardly past said cutting edge, an improvement comprising:

a conical seat formed of said support plate;

a hole through said adaptor from a top thereof to said seat;

a shear ring positioned within said hole;

a conical taper formed on said shear ring and extending downwardly therefrom;

means for fastening said seat in mating supportive contact with said taper;

a plurality of radial slots through said shear ring above said second taper; and means for forcing said shear ring to expand outwardly intermediate sid slots to cause an outer circumferential region of said shear ring to supportively contact said hole.

14. An improvement as in claim 13, wherein said fastening means comprises a bore from the top to a bottom of said support plate, a headed bolt and a nut; said forcing means comprises an additional conical taper on a respective one of said bolt head and said nut; and said shear ring includes a corresponding conical seat against which said additional conical taper bears.

15. An improvement as in claim 14, including:

a wear plate abutting the bottom of said support plate and having an extension of said bore therethrough;

a strap unitarily formed as part of said adaptor, said strap extending rearwardly along the bottom of said support plate from adjacent said cutting edge and terminating short of said bore;

a channel extending forwardly from a rearward end of said strap and upwardly from a bottom thereof, said channel having a cross-section which tapers inwardly; and a tongue unitary with and extending forwardly from said wear plate, said tongue having a cross-section which tapers at an angle to cause said tongue to abuttingly fit against the sides of said channel.

16. In a tooth mounting assembly for an earthworking implement which comprises a support plate having a cutting edge along a front side thereof and an adaptor for an earthworking tooth attached to said support plate and extending forwardly past said cutting edge, an improvement comprising:

a strap unitarily formed as part of said adaptor, said strap extending rearwardly along the bottom of said support plate from adjacent said cutting edge;

a wear plate abutting the bottom of said support plate;

a first bore from a top of said support plate to the bottom of said wear plate, said first bore being positioned beyond a rearward end of said strap;

a second bore from the top of said support plate to the bottom of said wear plate, said second bore being further removed from said cutting edge than is said first bore;

a channel extending forwardly from the rearward end of said strap and upwardly from a bottom thereof, said channel having a cross-section which tapers inwardly; and a tongue unitary with and extending forwardly from said wear plate, said tongue having a cross-section which tapers at an angle to cause said tongue to abuttingly fit against the sides of said channel.

* * * * *